US007520305B2

(12) United States Patent
Churchland et al.

(10) Patent No.: US 7,520,305 B2
(45) Date of Patent: Apr. 21, 2009

(54) SYSTEMS FOR ORIENTING STRANDS AND OTHER WOOD PARTICLES

(75) Inventors: Mark T. Churchland, Vancouver (CA); David J. McKenney, Viper, KY (US); Joseph B. Jenkins, Brookneal, VA (US); Dylan Gates, Vancouver (CA); Paul E. Chambers, North Vancouver (CA)

(73) Assignee: Weyerhaeuser NR Company, Federal Way, WA (US)

( * ) Notice: Subject to any disclaimer, the term of this patent is extended or adjusted under 35 U.S.C. 154(b) by 479 days.

(21) Appl. No.: 11/080,118

(22) Filed: Mar. 15, 2005

(65) Prior Publication Data

US 2006/0207687 A1 Sep. 21, 2006

(51) Int. Cl.
*B27C 1/00* (2006.01)

(52) U.S. Cl. ..... 144/218; 144/231; 144/232; 144/233; 144/237

(58) Field of Classification Search ..... 144/8, 144/231–233, 237, 28; 83/499, 508.3, 495, 83/663, 676, 698.41, 664; 241/236, 294–296, 241/243

See application file for complete search history.

(56) References Cited

U.S. PATENT DOCUMENTS 1,075,907 A * 10/1913 Dunton ..... 144/237
2,665,722 A * 1/1954 Edgemond, Jr. ..... 144/238
5,309,962 A * 5/1994 McCord et al. ..... 144/237

* cited by examiner

*Primary Examiner*—Shelley Self
(74) *Attorney, Agent, or Firm*—Weyerhaeuser Intellectual Property Department

(57) ABSTRACT

Systems for orienting strands and/or other types of particles are provided. The systems may have tabs which extend from orienting disks and/or collars and/or spacers which may be disposed on shafts. The tabs may prevent accumulation of strands between disks utilized within an orienting system. For example, the tabs may contact strands and/or other particles and guide or force the particles to be moved past the disks toward successive disks, or onto a screen or conveyor line.

13 Claims, 8 Drawing Sheets

SYSTEMS FOR ORIENTING STRANDS AND OTHER WOOD PARTICLES

FIELD OF THE INVENTION

This invention relates generally to systems for orienting strands and other particles used to manufacture engineered wood products. More specifically, the systems may utilize tabs which may extend from opposite sides/surfaces of disks or collars to guide and/or move strands toward a screen or conveyor during, for example, an alignment phase of engineered wood product formation.

BACKGROUND OF THE INVENTION

Engineered wood products utilize particles, such as strands, flakes, granules or the like as raw materials. For example, oriented strand board or TIMBERSTRAND® (manufactured by Weyerhaeuser Company) consists of layers of strands which are compressed to form the wood product. The strands are deposited onto, for example, a screen or directly onto the conveyor belt. Prior to being deposited, the strands are aligned by being dropped past a series of vertically-aligned disks which are disposed on one or more horizontally-aligned shafts positioned beside each other successively. These shafts and disks combine to form what is commonly referred to as a deck. The closer the disks are to one another as the strands fall through the disks, the greater the potential of achieving a desired alignment. Better alignment leads to optimal wood product properties, such as a high modulus of elasticity (MOE).

However, when longer and wider strands and/or other particles are utilized in formation of a wood product, the strands can get caught between the disks. The longer and wider strands tend to create plugs or "strand jams" in the deck. Often the plugs/jams occur between the middle deck and along one or both of the upper and lower decks. Most frequently, the plugs/jams occur on the upper deck and prevent the strands from reaching the middle deck. Removing these strands from the orienting disks can be a tedious, time-consuming and labor-intensive task. In addition, the removal may require stoppage of production, which is costly to a manufacturer.

A need, therefore, exists for systems for orienting strands and other particles which prevent accumulation of the particles between disks.

SUMMARY OF THE INVENTION

The present invention provides systems for orienting strands and other particles. Within one of the systems, an orienting disk may be provided having a top surface and a bottom surface, otherwise described as opposing sides. The disk may have an opening adjacent to, for example, a center of the disk. The opening may receive a shaft or rod which enables rotation of the disk around the shaft or rod. A tab may extend outward from the top surface. Additional tabs may extend from the top surface and/or the bottom surface. The tabs may prevent accumulation of strands between disks utilized within an orienting system. For example, the tabs may contact the strands and guide or force the strands to be moved past the disks toward successive disks, or onto a screen or conveyor line. In other systems of the present invention, one or more of these types of orienting disks may be disposed on one or more adjacently placed shafts.

In an embodiment, a system for orienting particles is provided. The system has a shaft and a first disk disposed on the shaft wherein the shaft extends through an opening in the disk. A second disk is disposed on the shaft wherein the shaft extends through an opening in the second disk. The first disk and the second disk have interior surfaces which face each other. A tab is provided between the first disk and the second disk. The tab is adjacent to the first disk and is substantially planar. Further, the tab is oriented non-parallel to the interior surface of the first disk.

In another embodiment of the present invention, a system is provided. The system has a disk having a substantially planar body and an opening within the body. A shaft extends through the opening in the disk. A collar is wrapped around the shaft. The collar is constructed from a rigid material and has a tab which extends from an end of the collar. The tab has a height within a range from 0.05 inches to 10 inches and a width in a range from 0.5 inches to 10 inches. This tab may guide and/or move strands through a deck and may prevent accumulation of strands within a deck.

It is, therefore, an advantage of the present invention to provide systems for orienting strands wherein the system prevents accumulation of strands within an engineered wood product forming system.

Additional features and advantages of the present invention are described in, and will be apparent from, the detailed description of the present embodiments and from the drawings.

BRIEF DESCRIPTION OF THE DRAWINGS

The embodiments of the present invention are described in detail below with reference to the following drawings.

DETAILED DESCRIPTION OF THE INVENTION

The present invention relates to systems for orienting strands and/or other particles which are pressed to form an engineered wood product. In an embodiment, an orienting disk may be provided which has a substantially planar body having a first surface and a second surface opposite to the first surface. An opening within the disk may extend from the first surface to the second surface. A tab may extend from the first surface in a direction non-parallel to the first surface. Additional tabs may extend from the first surface and/or the second surface. The tabs may prevent accumulation of strands between disks utilized within an orienting system. To this end, the tabs, as part of a deck, may contact the strands and/or other particles and guide or force the particles to be moved past the disks toward successive decks, or onto a screen or conveyor line. In other embodiments, systems may be provided in which a disk and/or collar and/or spacer are disposed around a shaft. A tab may extend from the disk and/or collar and/or spacer to guide strands and/or other types of particles.

Figure 1:
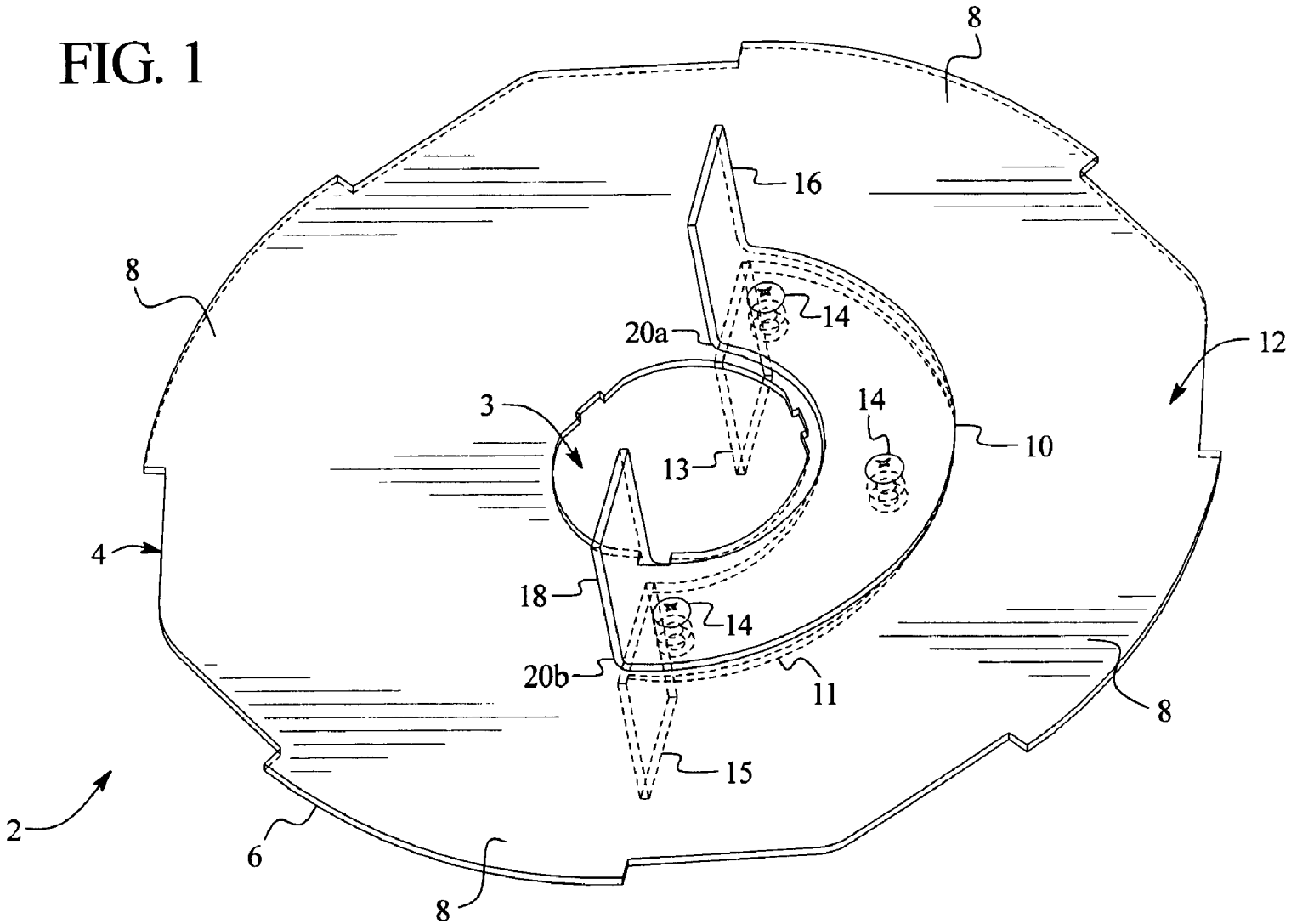
FIG. 1 is a perspective view of an orienting disk in an embodiment of the present invention.

Referring now to the drawings wherein like numerals refer to like parts, FIG. 1 illustrates a disk 2 having a substantially planar body 4 defining an edge 6 or perimeter. The body 4 may be constructed from wood, plastic, metal, rubber, or the like. Moreover, the body 4 may be substantially circular in shape and may have an opening 3. It is contemplated, however, that the body 4 may have any other shape suitable for use within any system for orienting strands, such as rectangular, triangular, oval, or any other variation thereof. As illustrated in FIG. 1, the disk 2 may have projections 8 at various points along the edge 6.

Figure 2:
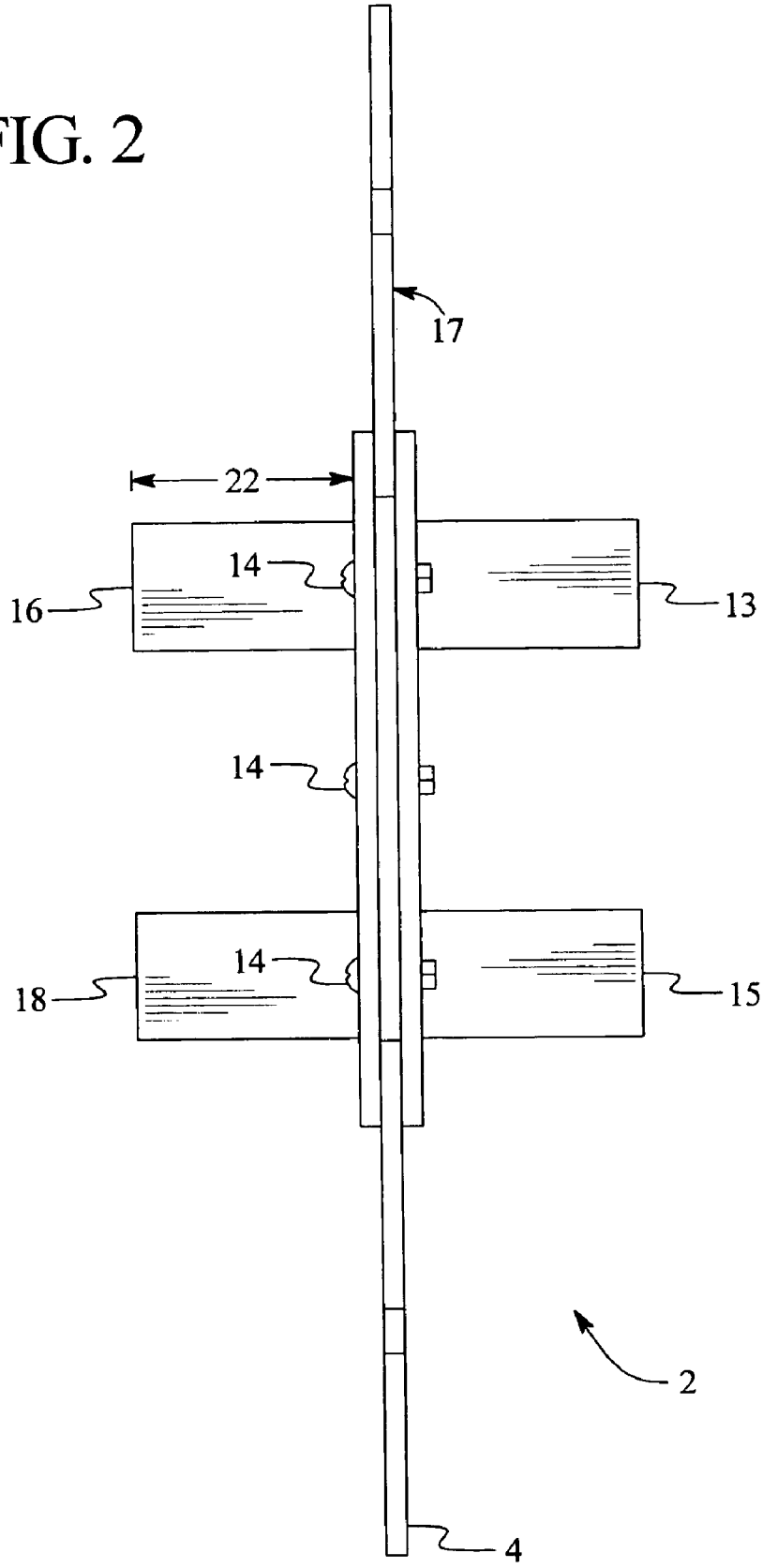
FIG. 2 is a side view of the orienting disk of FIG. 1.

A substantially U-shaped strip 10 may be attached to a surface 12 of the disk 2. The strip 10 may be attached via fasteners 14. Although the fastener 14 illustrated in FIG. 1 is a nut and bolt system, it is contemplated that any type of fastener may be used to attach the strip 10 to the disk 2, such as, rivets, adhesives, or other fastening devices and/or systems. Tabs 16, 18 may extend from ends 20*a*, 20*b* of the strip 10. In an embodiment, the tabs 16, 18 are integrally formed with the strip 10. In other embodiments, the tabs 16, 18 may be removably attached to the strip 10. In other embodiments, a strip 11 may be fastened to an opposite surface 17. The strip 11 may be semi-circular in shape and has tabs 13, 15 which may be similar in shape and/or size to the tabs 16, 18. The tabs 13, 15 may be attached to, or integrally formed with, the strip 11. FIG. 2 illustrates a side view of the disk 2. The tabs 13, 15, 16 and 18 may have a length 22 which may be in a range from 0.25 inches to 10 inches. In an embodiment, the tab 16 may have a different length than the tab 18. In an embodiment, the tab 13 may have a different length than the tab 15.

Figure 3:
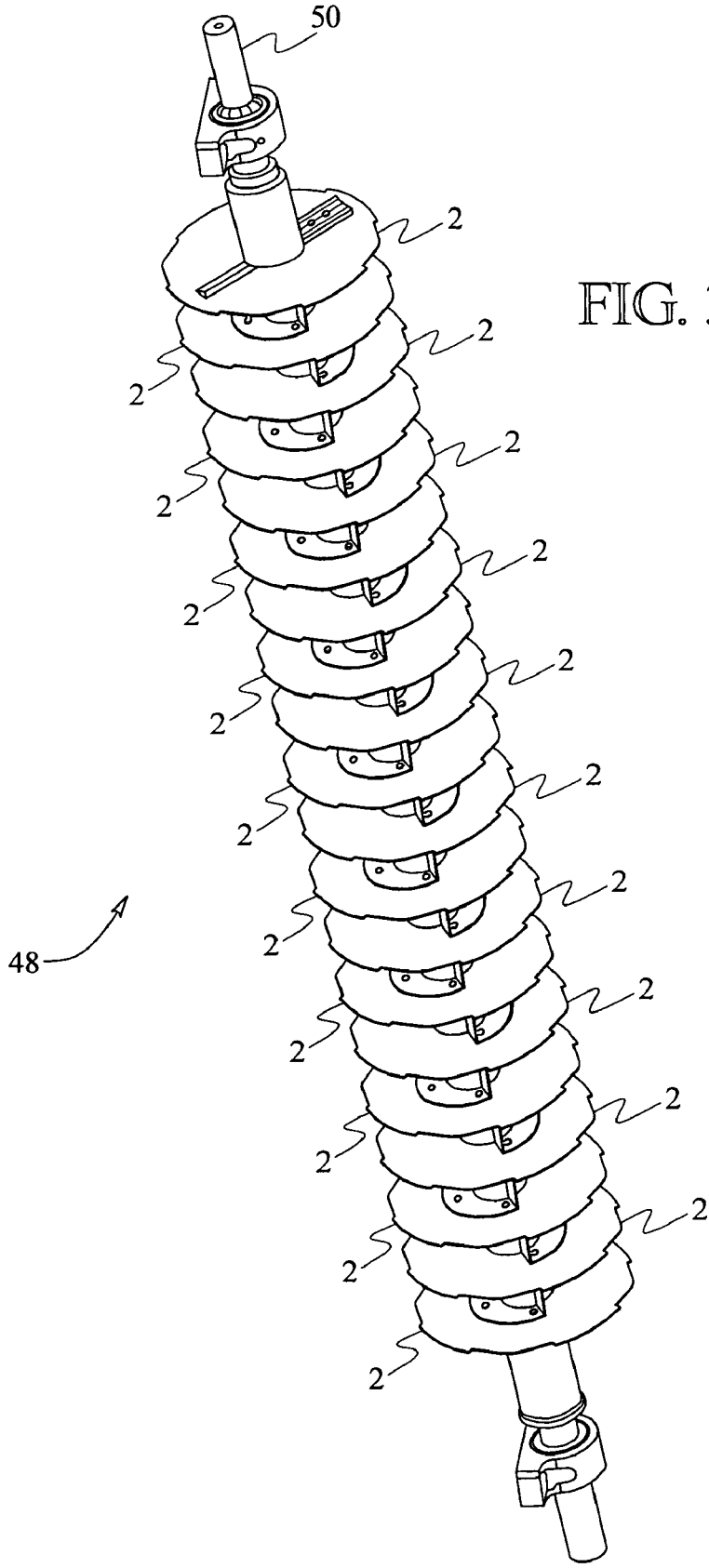
FIG. 3 is a perspective view of a shaft assembly in an embodiment of the present invention.
Figure 4:
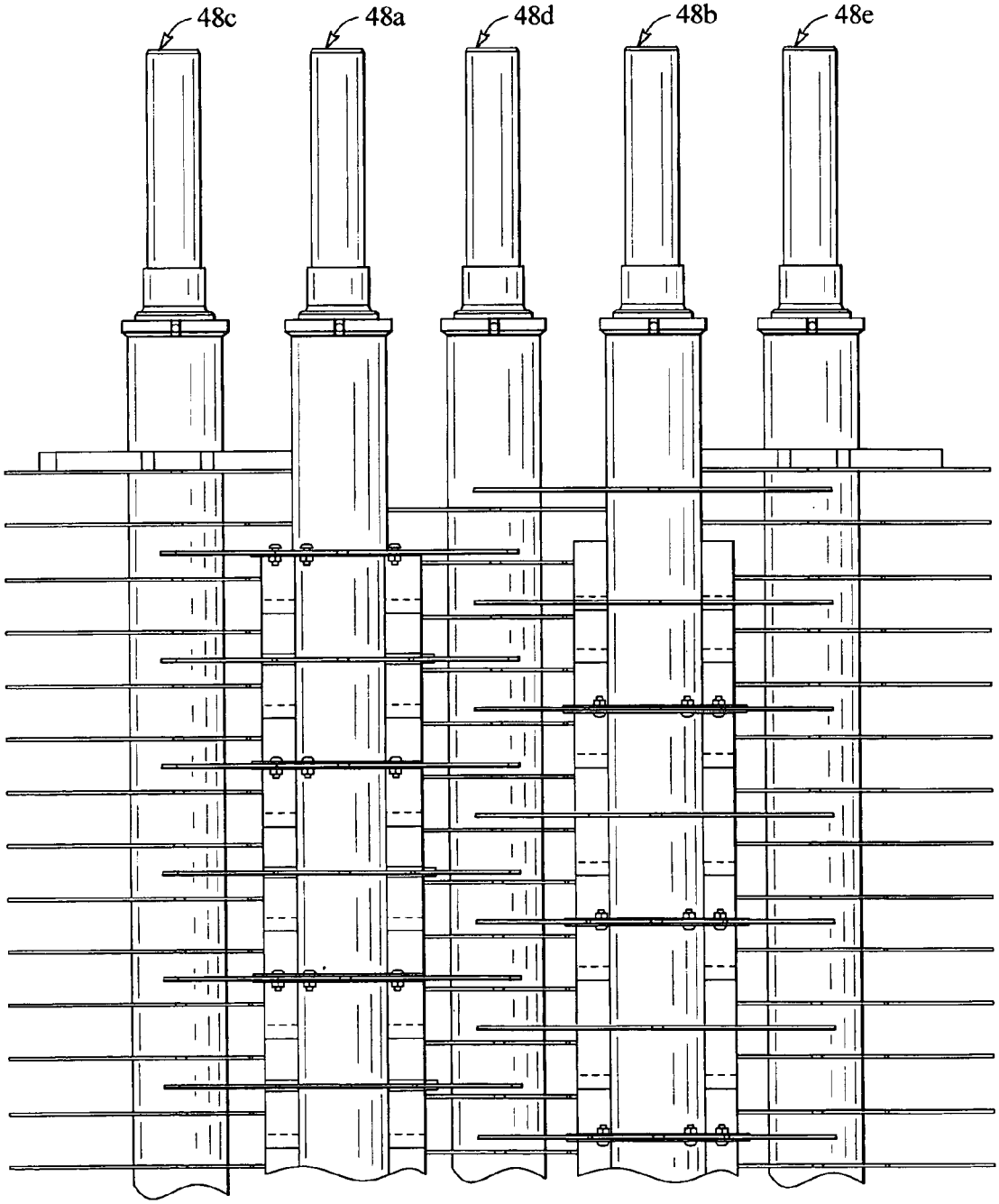
FIG. 4 is a partial top plan view of a system or deck for orienting strands in an embodiment of the present invention.

FIG. 3 illustrates a shaft assembly 48 having a shaft 50 which may hold a plurality of orienting disks 2. The disks 2 may rotate in correlation to rotation of the shaft 50 via mechanisms such as, for example, an interference fit, fasteners, adhesives, or other mechanical systems. The disks 2 may be spaced along the shaft 50, for example, wherein the tabs 16, 18 of a first disk are proximate to tabs 13, 15 of an adjacent disk. In an embodiment, the tabs 16, 18 overlap with the tabs 13, 15. This overlap is shown in dotted line in FIG. 4. This arrangement may enable the tabs 16, 18, 13, 15 to contact and guide strands which may be caught between adjacent disks 2. The strands may then be forced away from the disks 2 toward, for example, a conveyor belt or other area necessary for engineered wood production. FIG. 4 illustrates a top plan view of a system 60 or deck for orienting strands having various shaft assemblies 48*a*, 48*b*, 48*c*, 48*d* and 48*e*. Shaft assemblies 48*a* and 48*b* are positioned above shaft assemblies 48*c*, 48*d* and 48*e*. In an embodiment, only shaft assemblies 48*a* and 48*b* have disks with tabs to guide strands. In other embodiments, each shaft assembly 48*a*, 48*b*, 48*c*, 48*d* and 48*e* has disks with tabs. During the orienting process, strands and/or other particles may be dropped across the shaft assemblies 48*a* and 48*b*. These strands may eventually fall to the shaft assemblies 48*c*, 48*d* and 48*e*. If any strands are caught between the shaft assemblies 48*a* and 48*b*, the tabs 16, 18, 13 or 15 may guide or force the trapped strands to the next set of shaft assemblies 48*c*, 48*d* and 48*e* or next area for eventual placement onto a screen, conveyor belt, or other area.

Figure 5:
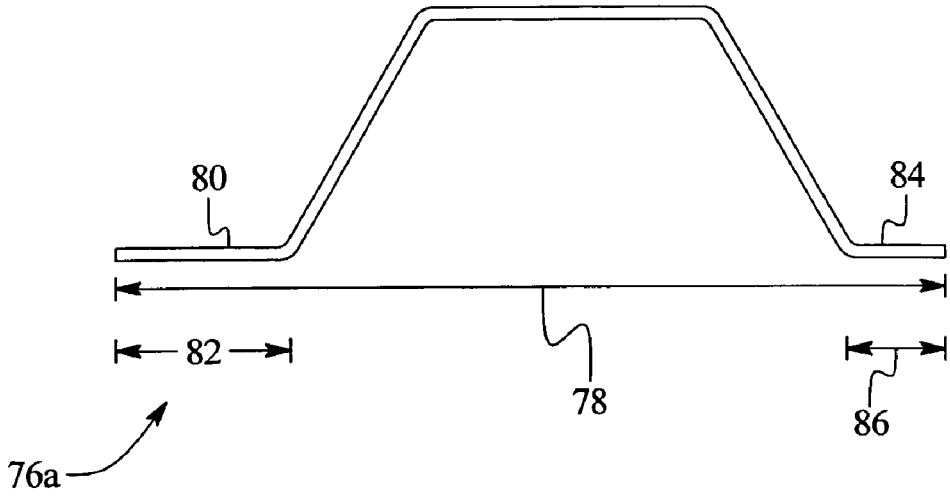
FIG. 5 is a side view of a collar which is implemented within a system for orienting particles in an embodiment of the present invention.
Figure 6:
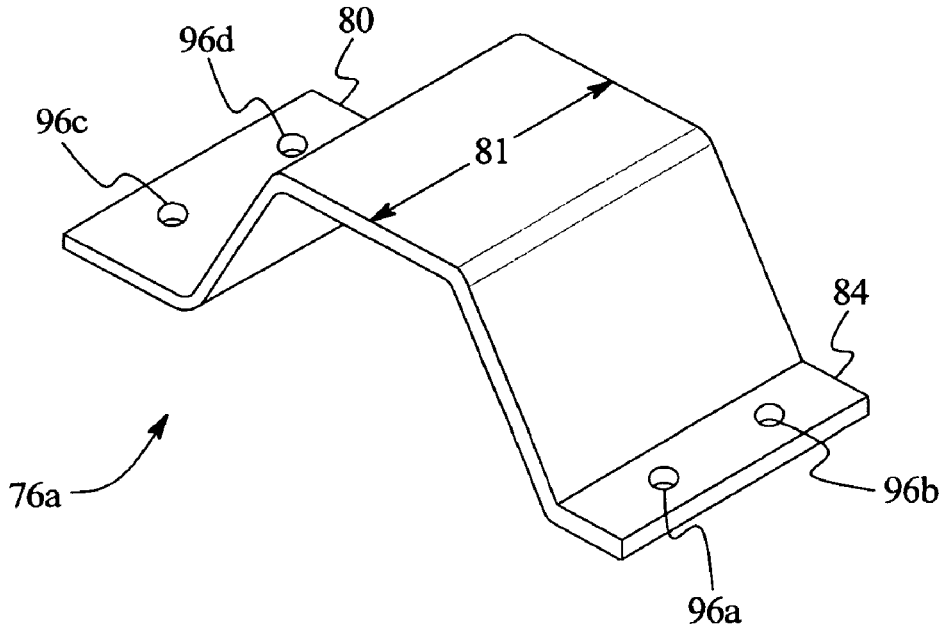
FIG. 6 is a perspective view of the collar of FIG. 5.
Figure 7:
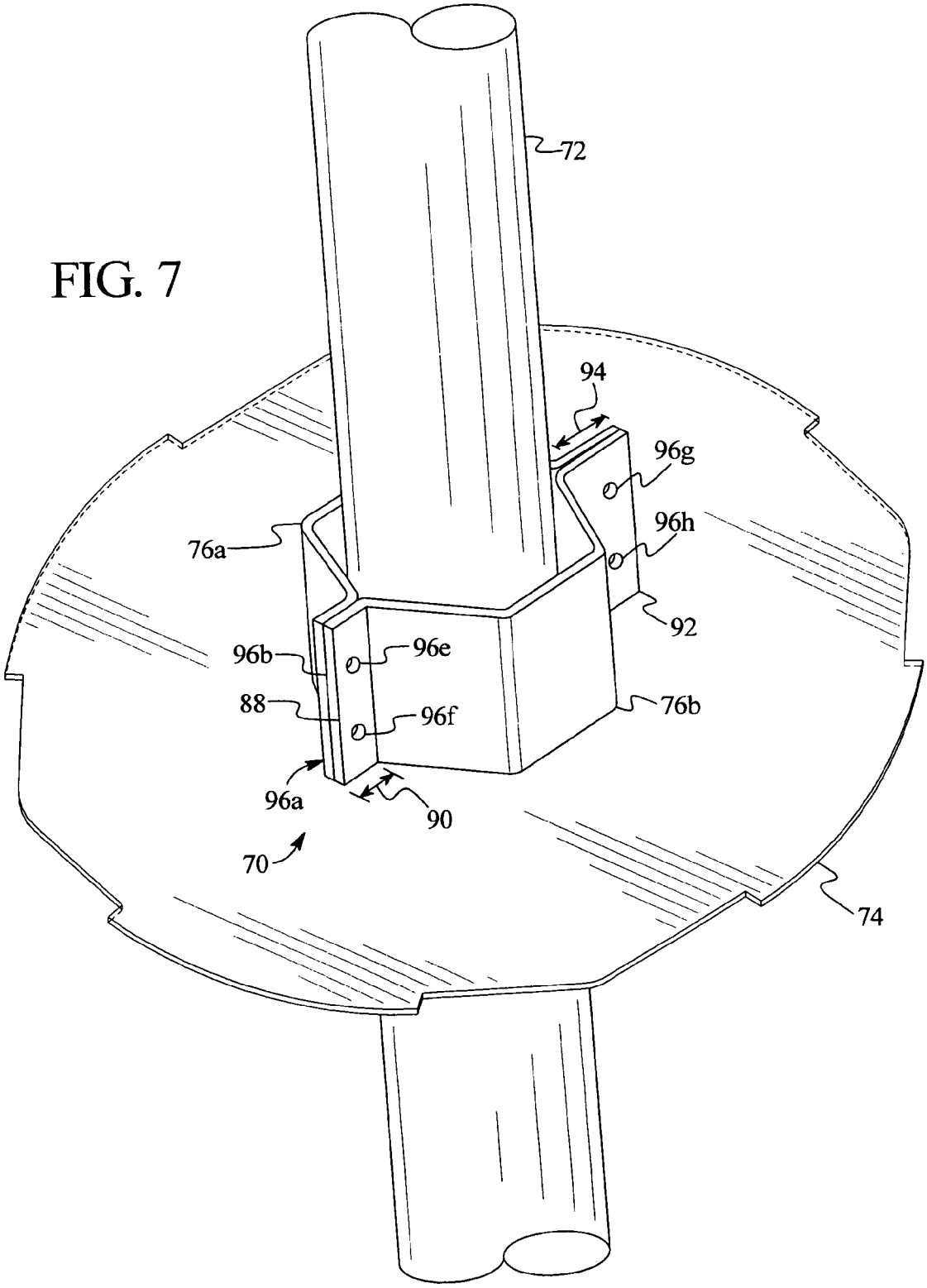
FIG. 7 is a perspective view of the collar of FIG. 5 secured to a shaft in a system for orienting strands.

FIGS. 5-7 illustrate a collar 70 which may be utilized in another embodiment of the present invention. The collar 70 may be secured around a shaft 72 of a shaft assembly and may be placed adjacent to an orienting disk 74, as illustrated in FIG. 7. Rotation of the shaft 72 may cause rotation of the collar 70. The collar 70 may be comprised of strips 76*a*, 76*b* which are constructed from a rigid material, such as, for example, rubber, plastic, wood, metal, or the like. The strips 76*a*, 76*b* may be, for example, trapezoidal in shape. However, any other shape is contemplated for the strips 76*a*, 76*b*, such as triangular, pentagonal, hexagonal, or other polygon type shape or substantially semi-circular shape. In FIG. 5, the overall shape of the collar 70 is hexagonal. However, this should not be construed as to limit any potential shape which the collar may have which may allow the collar 70 to perform its designated function (described below). The strips 76*a*, 76*b* may have an overall length 78 which may be in a range from three inches to twenty inches. The strip 76*a* may have a tab 80 which has a length 82 in a range from 0.25 inches to 10 inches and a tab 84 which may have a length 86 in a range from 0.25 inches to 10 inches. Likewise, the strip 76*b* may have a tab 88 having a length 90 in a range from 0.25 inches to 10 inches and a tab 92 which may have a length 94 in a range from 0.25 inches to 10 inches. The strips 76*a*, 76*b* may have a width 81 which may be in a range from 0.5 inches to 8 inches.

Holes 96*a*-96*h* may be provided in the tabs 80, 84, 88, 92 to enable the strips to be secured together when the tabs 80, 84, 88, 92 are aligned. More specifically, a user may align tab 80 with tab 88 and may align tab 84 with tab 92. Accordingly, holes 96*a* and 96*b* may be aligned with holes 96*e* and 96*f*; and holes 96*c* and 96*d* may be aligned with holes 96*g* and 96*h*. A fastener (not shown) such as, for example, a screw, bolt, or the like may be inserted through adjacent holes to secure the tab 80 to the tab 88, and secure the tab 84 to the tab 92. Referring again to FIG. 7, the collar 70 may be secured around the shaft 72 such that the collar 70 may rotate when the shaft 72 rotates. As a result, tabs 80, 84, 88, 92 may contact strands to move the strands and prevent accumulation within a deck. The tabs 80, 84, 88, 92 may function in a manner similar to that of the tabs 13, 15, 16 and 18.

The collar 70 and the tabs 13, 15, 16 and 18, when implemented in systems for orienting strands and/or other particles, allow for greater efficiency in engineered wood product formation. For example, the collar and tabs automatically guide and/or move strands to subsequent shaft assemblies and/or formation areas. This reduces labor typically expended by an individual to adjust and move strands which previously were accumulated within a shaft assembly. Moreover, by eliminating a need to stop production to remove and/or adjust accumulated strands, the collar 70 and the tabs 13, 15, 16 and 18 lower costs associated with engineered wood product formation, and reduce the time associated with manufacture of the wood products as well.

Figure 8:
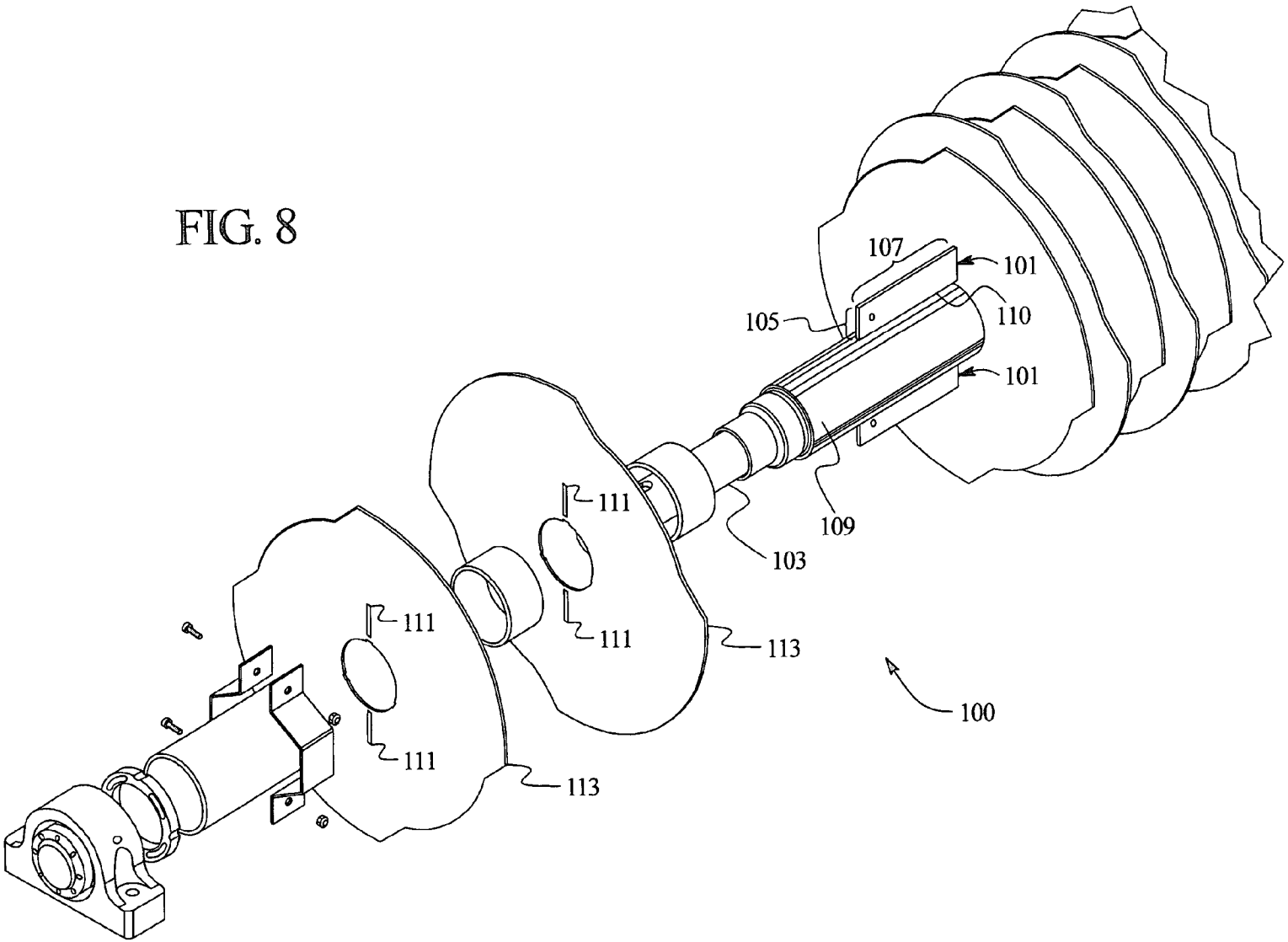
FIG. 8 is an exploded view of a system for orienting strands in an embodiment of the present invention.

FIG. 8 illustrates an exploded view of a shaft assembly 100 in which elongated tabs 101 are disposed along a length of a shaft 103. The tabs 101 may have a width 105 which may be in a range from 0.25 inches to 10 inches and a length 107 which may be in a range from 2 inches to 200 inches. The tabs 101 may be constructed from a rigid material such as, for example, wood, plastic, metal, or the like. In addition, the tabs 101 may be connected to a sheath 109, or may be directly connected to the shaft 103 along edges 110 via, for example, any suitable adhesive and/or fastener (not shown). Slits 111 may be provided in disks 113 and may be sized to allow for delivery of the tabs 101 through the slits 111. To this end, the slits 111 may have a width in a range from 0.25 inches to 10 inches.

The elongated tabs 101 may contact strands and/or other particles which are deposited on the shaft assembly 100 and guide the strands and/or other particles towards the next designated area for engineered wood production. The use of an elongated tab 101 may enable a shaft assembly to be constructed with greater convenience, as attachment of a plurality of tabs to a plurality of disks may not be required. Moreover, constructing a single elongated tab 101 may offer lower manufacturing costs as opposed to manufacturing of a plurality of U-shaped tabs described in the previous embodiments.

Figure 9A:
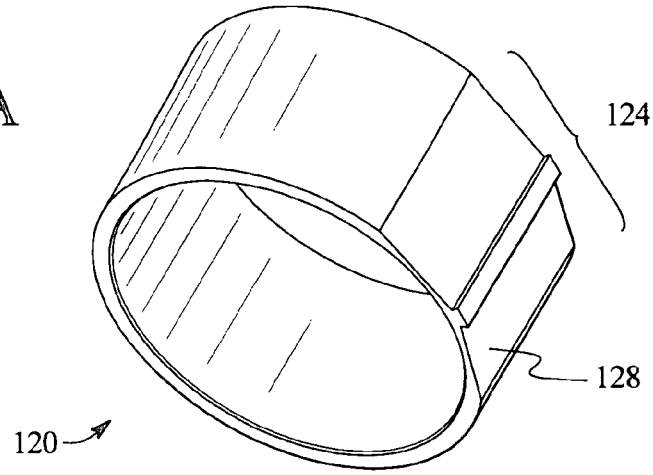
FIG. 9A is a perspective view of a shaft spacer in an embodiment of the present invention.
Figure 9B:
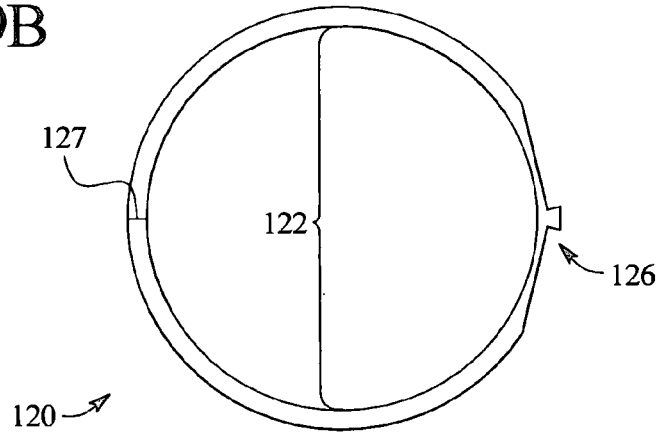
FIG. 9B is a side view of the shaft spacer of FIG. 9A.
Figure 9C:
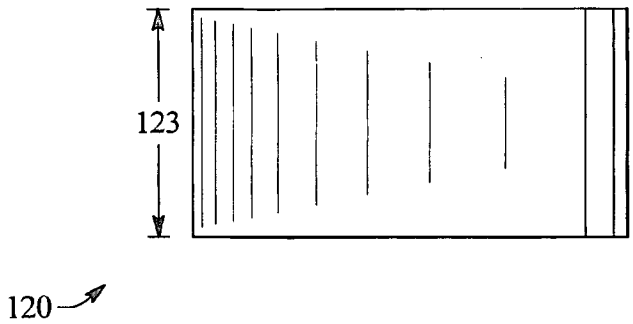
FIG. 9C is a top plan view of the shaft spacer of FIG. 9A.

FIGS. 9A, 9B and 9C illustrate a shaft spacer 120 in an embodiment of the present invention. The shaft spacer 120 may be substantially cylindrical in shape, having a diameter 122 in a range from 1 inch to 10 inches and may be constructed from wood, plastic, metal, or other rigid material. The spacer 120 may have a width 123 in a range from 0.50 inches to 10 inches and a thickness 127 in a range from 0.05 inches to 5 inches. A portion 124 of the spacer 120 may be flat and may have a ridge or tab 126 formed along a surface 128 of the portion 124. The ridge 126 may extend across the width 123 of the spacer 120 and may have a height 129 in a range from 0.05 inches to 5 inches. The spacer 120 may be placed over a shaft and may be used to separate disks also disposed on the shaft. The ridge 126 formed on the spacer 120 may contact strands and/or other particles dropped across the shaft, as the shaft and spacer 120 rotate, to guide the strands to a designated area for production of an engineered wood product.

While the embodiments of the invention have been illustrated and described, as noted above, many changes can be made without departing from the spirit and scope of the invention. Accordingly, the scope of the invention is not limited by the disclosure of the embodiments. Instead, the invention should be determined entirely by reference to the claims that follow.

What is claimed is:

1. A system for orienting particles, the system comprising:

a shaft;

a first disk disposed on the shaft wherein the shaft extends through an opening in the disk;

a second disk disposed on the shaft wherein the shaft extends through an opening the second disk and wherein the first disk and the second disk have interior surfaces which face each other and define a gap sized and configured to orient particles as said particles pass between the first and second disks; and a tab extending across at least a portion of the gap defined between the first disk and the second disk wherein the tab is adjacent to the first disk and wherein the tab is substantially planar and is oriented non-parallel to the interior surface of the first disk wherein a slot exists within the first disk and wherein the tab extends through the slot.

2. The system of claim 1 wherein the tab is attached to the first disk.

3. The system of claim 1 further comprising; a collar disposed on the shaft wherein the tab extends from an end of the collar.

4. The system of claim 1 wherein the tab has a length in a range from 0.05 inches to 10 inches.

5. The system of claim 1 wherein the tab has a width in a range from 0.5 inches to 10 inches.

6. The system of claim 1 further comprising: a second tab extending from the interior surface of the second disk.

7. The system of claim 1 further comprising: a second tab extending from the first disk from a surface opposite to the interior surface.

8. A system for orienting particles, the system comprising:

a shaft;

a first disk on the shaft;

a second disk on the shaft wherein the first disk and the second disk have inner surfaces facing each other and defining a gap sized and configured to orient particles as said particles pass between the first and second disks;

a first tab extending across at least a portion of the gap from the inner surface of the first disk through a slot in the first disk, toward the second disk; and a second tab extending across at least a portion of the gap from the inner surface of the second disk toward the first disk.

9. The system of claim 8 further comprising: a third tab extending from the inner surface of the first disk toward the second disk.

10. The system of claim 8 further comprising: a second shaft having a third disk and a fourth disk on the second shaft wherein the third disk and the fourth disk are on opposite sides of the first disk.

11. The system of claim 8 wherein the first tab and the second tab extend more than halfway between the first disk and the second disk.

12. A system for orienting particles, the system comprising:

a shaft;

a first disk on the shaft wherein the shaft extends through an opening in the first disk and wherein a slit is formed in a body of the first disk b we n the opening and a perimeter of the first disk;

second disk on the shaft wherein the shaft extends through an opening in the second disk and wherein a slit is formed in a body of the second disk between the opening and a perimeter of the second disk;

a gap defined between the first and second disks that is sized and configured to orient particles as said particles pass between the first and second disks; and a tab having a substantially planar shape extending across the gap and through the slit in the first disk and the slit in the second disk.

13. The system of claim 12 wherein the tab has a length substantially similar to a length of the shaft.

* * * * *